United States Patent [19]

Matsuoka

[11] Patent Number: 4,840,575

[45] Date of Patent: Jun. 20, 1989

[54] CARD CONNECTOR

[75] Inventor: Noriyuki Matsuoka, Tokyo, Japan

[73] Assignee: Yamaichi Electric Mfg. Co., Ltd., Tokyo, Japan

[21] Appl. No.: 198,931

[22] Filed: May 24, 1988

[30] Foreign Application Priority Data

May 30, 1987 [JP] Japan ..... 62-136400

[51] Int. Cl.[4] ..... H01R 11/22; H01R 13/62

[52] U.S. Cl. ..... 439/267; 439/265

[58] Field of Search ..... 439/259, 260, 261, 265, 439/266, 267, 325

[56] References Cited

U.S. PATENT DOCUMENTS 4,540,228 9/1985 Steele ..... 439/260 X
4,626,056 12/1986 Andrews, Jr. et al. ..... 439/260
4,629,270 12/1986 Andrews, Jr. et al. ..... 439/260
4,743,203 5/1988 Grabbe ..... 439/267 X

FOREIGN PATENT DOCUMENTS 0151253 8/1985 European Pat. Off. ..... 439/259

*Primary Examiner*—Eugene F. Desmond
*Assistant Examiner*—Stephen Zagrobelny
*Attorney, Agent, or Firm*—Wenderoth, Lind & Ponack

[57] ABSTRACT

A card connector, having a card insertion slit in a connector body and a resilient contacting piece for engaging a card inserted in the slit, uses just a single cam block having a card supporting surface for supporting and moving a card inserted into the card insertion slit. A plain cam surface on the single cam block opens and closes the contacting piece for allowing the card to be easily inserted and for moving a contact surface of the contacting piece against the card for rubbing the card to improve the electrical contact when the card is subsequently moved. The single cam block is diagonally movably supported on the connector body for movement along a diagonal movement path. The contacting piece and the contacting piece opening/closing plain cam surface are arranged such that the contacting piece is opened by the downward diagonal movement of the cam block for permitting the card to be inserted with no load, the card is pushed up and the contacting piece is closed by the initial upward diagonal movement of the cam block, and the card is further pushed up while keeping the contacting piece closed in order to obtain sliding contact between the card and the contact surface.

3 Claims, 5 Drawing Sheets

CARD CONNECTOR

BACKGROUND OF THE INVENTION

1. Field of the Invention

This invention relates to a card connector in which a cam block for opening and closing a contact is located in a connector, and more particularly to a novel mechanism in which a card is inserted with no load and after insertion, the contacting surface thereof is slide contacted.

The term "card", when used herein, means a wiring board or an IC card having many contacting points for contacting with many contacts arranged on a connector body.

2. Description of the Prior Art

Heretofore, there has been known a conventional card connector, in which a slit formed in a connector for inserting a card therethrough is provided at a bottom portion thereof with a vertically movable cam block for opening/closing a contact, the cam block being vertically moved by suitable means such as an eccentric cam block or a crank lever, the upward movement of the vertically movable cam block pressurizing and opening the contact thereby to allow the card to be inserted with no load, the downward movement of the vertically movable cam block canceling the pressure against the contact to close the contact.

In the cam block of the above-mentioned prior art, the vertical up and down movement of the cam block opens or closes the contact, and during the upward movement of the cam block, the contact is opened by the ascending component and the contact is closed by the descending component.

For example, when the contact is urged against the contacting point of a card thereby to hold the card, even if the cam block is descended, the card cannot be descended downward from the holding position and as a result, it becomes difficult for the card to be slide contacted with the contact. Even if it can be presumed that the contact is opened/closed by the vertical up-down movement of the cam block and the card is moved to be slide contacted with a card contacting piece, the vertical movement stroke of the cam block becomes long and, as a result, the contact becomes long in the vertical direction and the connector becomes bulky. Furthermore, it is difficult to move the cam block in the vertical direction by pushing and the pushing operation becomes heavy.

SUMMARY OF THE INVENTION

According to the present invention, therefore, in the above-mentioned card connector, a single cam block is disposed within the connector body. A supporting surface of a card inserted from an inserting slit formed in the cam block is formed by a surface opposite the inserting slit. A plain cam surface for opening/closing a contact is formed by a surface opposite the contact of the cam block. The cam block is diagonally movably supported on the connector body for movement along a diagonal movement path. The contact is opened by the downward diagonal movement of the cam block so as to permit the card to be inserted with no load, whereas the contact is closed by a composition of a vertical movement during the first half of the upward diagonal movement of the cam block while pushing up the card by the card supporting surface, so as to contact the card with a card contacting point. The card is further pushed up while the closing state of the contact is maintained by the latter half of the successive upward diagonal movement, so that the card is slide contacted with a card contacting point and the card is supported at a supporting point for push-up.

As described in the foregoing, according to the present invention, the cam block is diagonally movably supported with respect to the connector, and the cam block, the contact and the card are cooperatively acted as such that the contact is opened by the downward diagonal movement of the cam block, the card is pushed up and the contact is closed by the first half of the upward diagonal movement of the cam block, and the contact is closed and the card is pushed up successively by the latter half upward diagonal movement of the cam block. By this, the contact can be opened or closed and contacted for inserting the card with no load, the contact can be slide contacted with the card contacting point so as to obtain a wholesome contact, and the card can be safely supported after the contact is slide contacted with the card contacting point. Such series of action as just mentioned can be correctly and efficiently performed by the downward diagonal movement of the cam block, the first half of the upward diagonal movement of the cam block, and the latter half of the upward diagonal movement of the cam block.

As described above, the card is safely supported after the contact is slide contacted with the card contacting point, so as to satisfactorily hold the slide contact portion and assure a highly reliable contact.

Furthermore, a moving dimension long enough for allowing the cam block to effect a predetermined action can be obtained in the diagonal path. Moreover, the design of the moving mechanism for permitting the above-mentioned action is easy and a reliable action can be obtained. In addition, the dimension of the component of the vertical movement is small which is advantageous for making the contact and the connector small.

Still further, according to the present invention, one end of the cam block and the other end thereof can be moved diagonally by pushing operation, and therefore, the operating force can be reduced with respect to the opening/closing load of the contact compared with the vertical movement operation.

BRIEF DESCRIPTION OF THE PRESENT INVENTION

The drawings illustrate the embodiment of the present invention, wherein.

DETAILED DESCRIPTION OF THE EMBODIMENT

Figure 1:
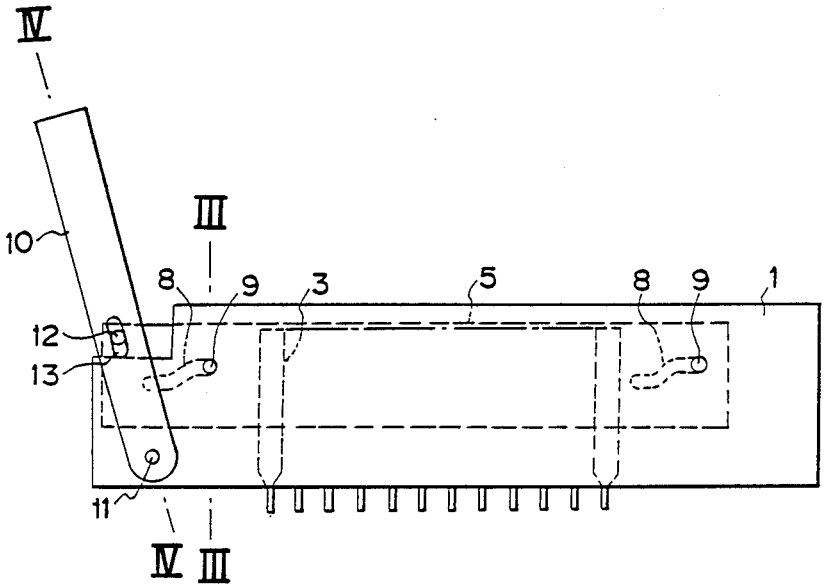
FIGS. 1 and 2 are side views of a card connector before and after the upward diagonal movement of a cam block.

The embodiment of the present invention will be described hereunder with reference to the accompanying drawings.

In the figures, 1 denotes a card connector body comprising an elongated insulation block. The card connector body 1 is provided with a card inserting slit 2. The card connector body 1 has a plurality of contacts 3 disposed in juxtaposed relation along one side surface thereof and in the elongated direction within the card inserting slit 2. Each of the contacts 3 is of a single contacting piece structure. When a card 4 is inserted into a card inserting slit 2, the contact 3 is resiliently contacted with a contacting point disposed to a side surface of an inserting portion of the card 4 in the elongated direction.

The card connector body 1 contains therein a single cam block 5. A card supporting surface 6 is defined by a surface opposite the card inserting slit 2 of the cam block 5, whereas a plain cam surface 7 for opening/closing a contact 3 opposite the contacting surfaces of the plain cam surface 7 (see FIG. 7) of the cam block 5 is defined by a surface opposite the plurality of contacts 3. The plain cam surface 7 is formed, as shown for example in FIG. 8(B), by hills *7a* and valleys *7b* periodically formed in the direction where the plurality of contacts are juxtaposed. Otherwise, the plain cam surface 7 is provided, as shown for example in FIG. 8(A), with a simple continuous hill *7a* and cooperatively acted with the contacts 3 by the diagonal movement of the cam block 5 as will be described afterward.

The cam block 5 is diagonally movably supported on the connector body 1 through a diagonal movement guide mechanism.

Figure 9:
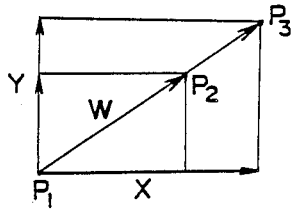
FIG. 9(A) is a schematic view of a path for explaining the upward diagonal movement of the cam block and the action thereof.
FIG. 9(B) is a schematic view of a path for explaining the downward diagonal movement of the cam block and the action thereof.
Figure 8:
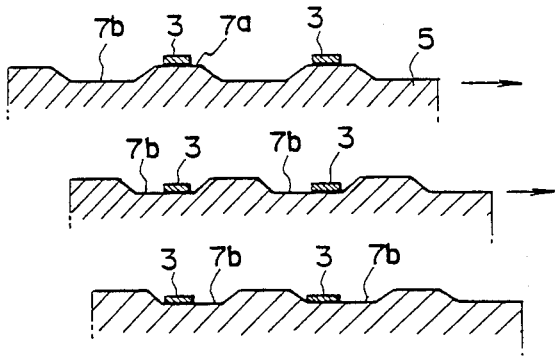
Figure 9:
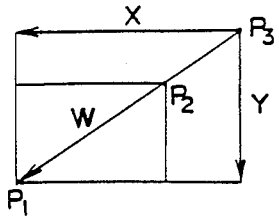

The cam block 5 is diagonally moved, through the diagonal movement guide mechanism, along a diagonal movement path W, which, as shown in FIG. 9, includes a vertical movement component for movement in the card inserting/withdrawing direction and a horizontal movement component X perpendicular to the card inserting/withdrawing direction.

As one example of the guide mechanism, as shown in FIGS. 1 through 4, an unnumbered side surface of cam block 5 opposite the contact opening/closing plain cam surface 7 of the cam block 5 is contacted with an unnumbered inner side surface of the card inserting slit side wall opposite the side surface to form an unnumbered slide contact surface. One part of the guide mechanism is that the cam block 5 is formed with a diagonal movement guide groove cam 8 and the diagonal movement guide groove cam 8 is snugly fitted with a slider 9 projecting from the other so that the cam block 5 is supported on the side wall of the connector body 1. Owing to the foregoing arrangement, the cam block 5 is diagonally movably supported on the connector body 1. In the illustrated example, the diagonal movement guide groove cam 8 is formed in the cam block 5 and the slider 9 projects from the side wall of the connector body 1. The guide mechanism comprising the groove cam 8 and the slider 9 is well balancedly arranged at least on both ends of the cam block 5.

As means for moving the cam block 5, as shown in FIGS. 1 through 4, a lever mechanism may be employed. Otherwise, the end portion of the cam block 5 may be pushed.

In the case of using a lever mechanism, the root end of a lever 10 is swingably supported on the outer surface of one end portion of the connector body 1 through a shaft 11, and the lever 10 extends upward along the connector side surface. Between the shaft 11 and the free end of the lever 10, a slider 12 projecting from the end portion of the cam block 5 is snug fitted into an elongate hole 13 in the longitudinal direction of the lever 10.

Figure 2:
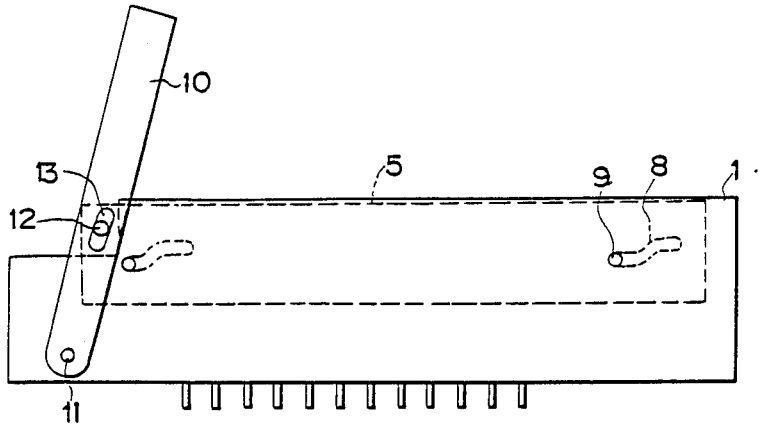
Figure 4:
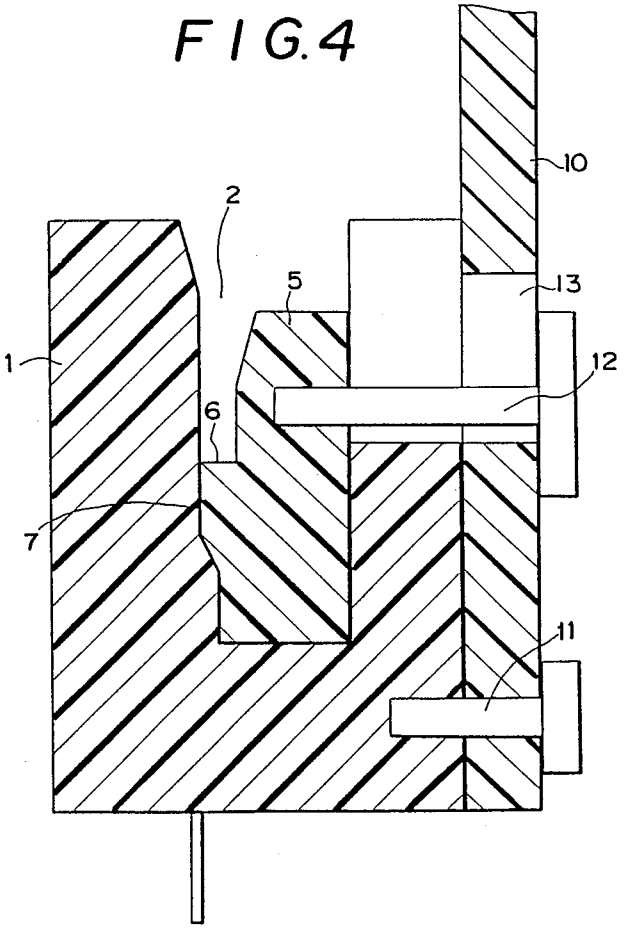
FIG. 4 is a sectional view taken along the line IV—IV of FIG. 1.
Figure 3:
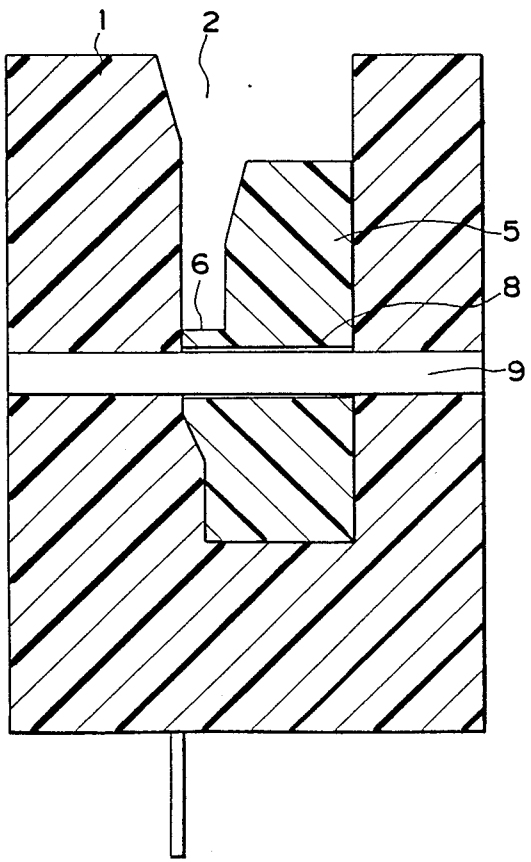
FIG. 3 is a sectional view taken along the line III—III of FIG. 1.

When the lever 10 is swung clockwise about the shaft 11 as seen in the figures, a horizontal movement force is rendered to the cam block 5 through the elongate hole 13 and slider 12, and the cam block 5, as shown in FIG. 1, FIG. 2 and FIG. 9, is diagonally moved upward along the diagonal movement path which includes the vertical movement composition Y and the horizontal movement composition X, through the guide mechanism comprising the diagonal movement guide cam groove 8 and the slider 9.

When the lever 10 is swung counterclockwise about the shaft 11 as seen in the figures, the cam block 5 is diagonally moved downward through the diagonal movement guide mechanism.

In the case when no lever is provided and cam block 5 is simply pushed, push operation portion is formed by projecting both ends of the cam block 5 from both ends of the connector body 1 for example. In this case, the cam block 5 is diagonally moved upward or downward by pushing the push operation portion using the operator's finger or a tool. Such an embodiment is not shown as the structure is readily understandable to a person having ordinary skill in the art.

In case a tool inserting opening is formed in the end portion of the connector body 1, the end portion of the cam block 5 is not necesarily projected from the connector body 1.

The end portion of the cam block 5 can be pushed by inserting a tool such as, for example, a driver into the tool inserting opening formed in the end portion of the connector body 1 and turning the driver.

Another example is that an opening communicating with the tool inserting opening formed in the end portion of the connector body 1 and adapted to permit a tool to pass therethrough is formed in the end portion of the cam block 5, the tip of a tool such as a driver inserted from the tool inserting opening is further inserted into the opening for permitting a tool to pass therethrough, and the tip of the tool, while being supported on the wall of the connector body side, is turned, thereby to render a horizontal movement force to the cam block 5.

The correlation among the upward/downward diagonal movement of the cam block 5, the opening/closing of the contact by the contact opening/closing plain surface 7, and the support of the card is established as follows.

Figure 5:
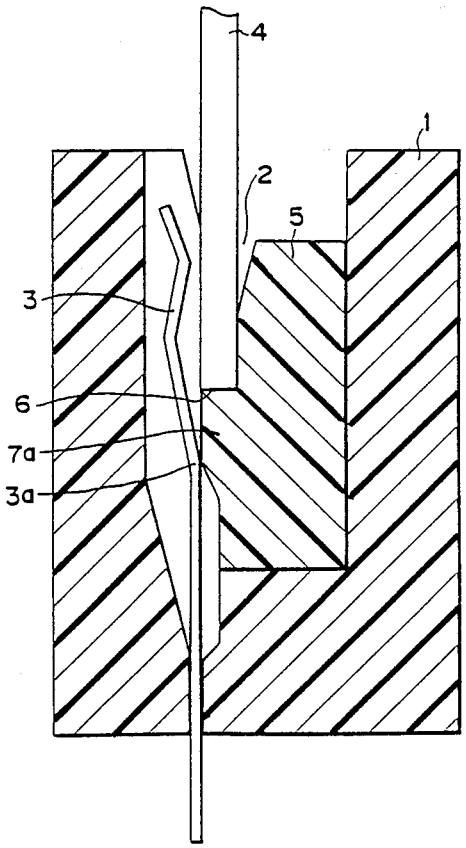
FIG. 5 is a sectional view of a card connector when the cam block is in the lower dead point of the diagonal movement.
Figure 8:
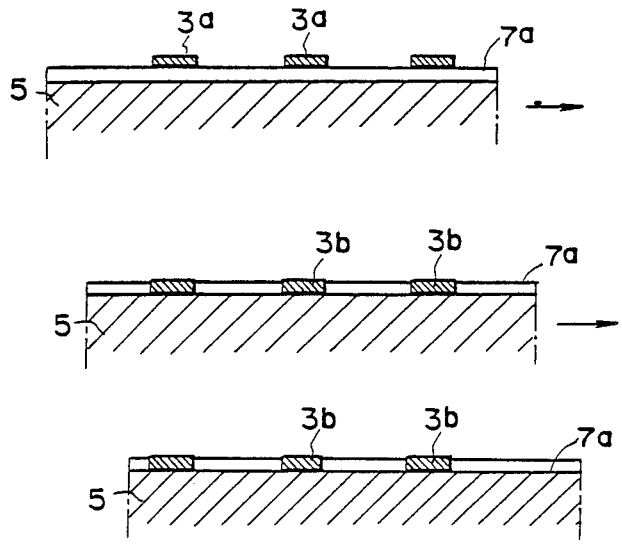
FIG. 8(A) is a sectional view of a cam block for explaining one example of the configuration of a plain cam surface for opening/closing the card of the cam block and the opening/closing of the contact.
FIG. 8(B) is a sectional view of the cam block for explaining another example of the configuration of a plain cam surface for opening/closing the card of the cam block and the opening/closing of the contact.

First, as shown in FIGS. 5, 8(A) and 9(B), when the cam block 5 is diagonally moved downward along the diagonal movement path W and reaches a lower dead point $P_1$, the hill portion 7*a* of the contact opening/closing plain cam surface 7 presses against the projecting portion 3*a* of the contact to form an opening state. In the opening state, the card 4 is permitted to be inserted into the card inserting slit 2 with no load and the lower end of the card 4 is supported at the level when the card 4 is inserted for a predetermined depth. The same is true with the example shown in FIG. 8(B).

Figure 6:
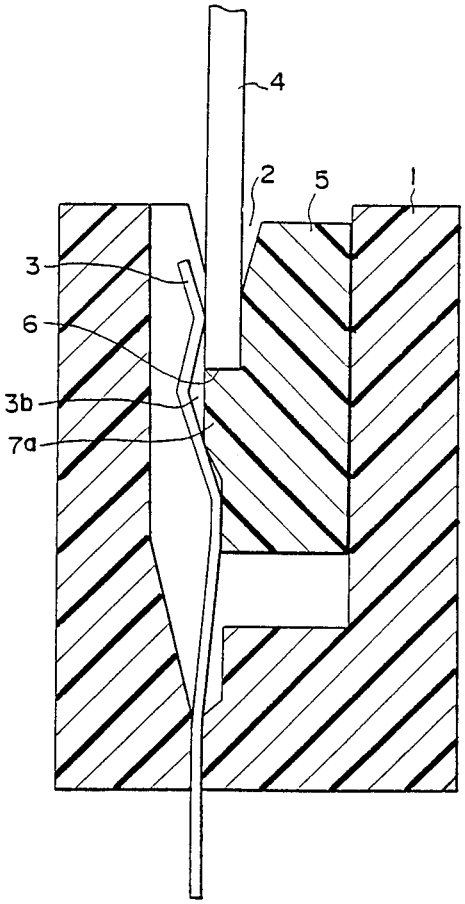
FIG. 6 is a sectional view of a card connector when the cam block is in the intermediate point of the diagonal movement.

When the cam block 5 is diagonally moved upward, as shown in FIG. 6, FIG. 8(A), and FIG. 9(A), while pushing up the card 4 by the card supporting surface 6 in the first half of the vertical movement component Y until the cam block 5 reaches the diagonal movement intermediate point $P_2$ in the first half of the upward diagonal movement, an escape portion 3*b* of the contact 3 is brought to be opposite the hill portion 7*a* of the contact opening/closing plain cam surface 7, and as a result, the contact is displaced inward so that it is resiliently contacted with the contacting point located at the side surface of the lower end of the card 4. Similarly, in the plain cam surface 7 having a configuration as shown in FIG. 8(B), the contact 3 is not formed with the projecting portion 3*a* nor the escaping portion 3*b*, and the contact 3 is merely permitted to escape into the valley portion 7*b* to obtain the afore-mentioned resilient contact.

Figure 7:
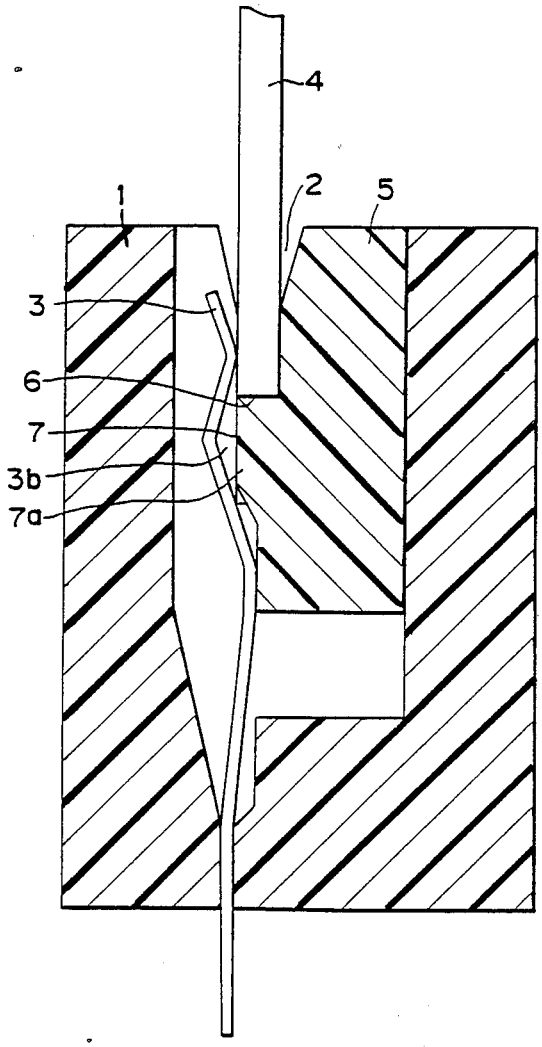
FIG. 7 is a sectional view of a card connector when the cam block is in the upper dead point of the diagonal movement.

Furthermore, in the successive latter half upward diagonal movement of the cam block 5 as shown in FIG. 7, FIG. 8A and FIG. 9A, the corresponding relationship between the hill portion 7*a* of the contact opening/closing plain cam surface 7 and the escaping portion 3*b* of the contact 3 remains constant, on, therefore, resilient contact between the contact 3 and the card contacting point is maintained, and in the meantime, the slide contact between the contact 3 and the card contacting point while pushing up the card 4 by the card supporting surface 6 in the latter half of the vertical movement component is maintained Y. Because of the foregoing arrangement, the cam block 5 maintains the contact at the slide contact part while supporting the card at the upper dead point $P_3$ in the upward diagonal movement.

Similarly, in the plain cam surface 7 having a configuration as shown in FIG. 8(B), the corresponding relationship between the contact 3 and the valley portion 7*b* is maintained and and the contacting relationship between the contact 3 and the card contacting point is maintained, and in the meantime, the card is pushed up.

The moving amount of the first and the second halves of the upward diagonal movement is not necessarily one of the two equally divided parts. The proportion thereof is only a matter of design.

A reverse movement to the one shown in FIGS. 8(A) and 8(B) is obtained by moving the cam block 5 from the upper dead point $P_3$ in the upward diagonal movement to the lower dead point $P_1$ in the downward diagonal movement along the diagonal movement path W as shown in FIG. 9(B). As a result, the contact 3 is opened again for permitting the card 4 to be inserted with no load.

As described in the foregoing, according to the present invention, a cam block is diagonally movably supported with respect to a connector, and the cam block, a contact and a card are cooperatively acted as such that the contact is opened by the downward diagonal movement of the cam block, the card is pushed up and the contact is closed by the first half of the upward diagonal movement of the cam block, and the card is further pushed up and the contact remains closed during the latter half of the upward diagonal movement of the cam block. By this, the contact can be opened or closed and contacted for inserting the card with no load, the contact can be slide contacted with the card contacting point so as to obtain a wholesome contact, and the card can be safely supported after the contact is slide contacted with the card contacting point. Such series of action as just mentioned can be correctly and efficiently performed by the downward diagonal movement of the cam block, the first half of the upward diagonal movement of the cam block, and the latter half of the upward diagonal movement of the cam block.

As described above, the card is safely supported at the dead point of the slide contact of the contacting point, so as to satisfactorily hold the slide contact portion and assure a highly reliable contact.

Furthermore, a moving dimension long enough for allowing the cam block to effect a predetermined action can be obtained in the diagonal movement path. Moreover, the design of the moving mechanism for permitting the above-mentioned action is easy and a reliable action can be obtained. In addition, the dimension of the composition of the vertical movement is small which is advantageous for making the contact and the connector small.

Still further, according to the present invention, one end of the cam block and the other end thereof can be moved diagonally by pushing operation, and therefore, the operating force can be reduced with respect to the opening/closing load of the contact compared with the vertical movement operation.

Although this invention has been described in its preferred form with a certain degree of particularity, it is understood that the present disclosure of the preferred form has been made only by way of example and that numerous changes in the details of construction and arrangement of parts may be resorted to without departing from the spirit and the scope of the present invention as hereinafter claimed.

What is claimed is:

1. A card connector comprising:

a main body having a card insertion slit for receiving a card therein;

at least one resilient contacting piece attached to said main body and adjacent to said insertion slit, and each said at least one contacting piece having a contact surface means for contacting a card when a card is received in said insertion slit and for rubbing a card when a card is received in said insertion slit and is moved relative to said contact surface means when said at least one contacting piece is in a closed position against a card;

a single cam block reciprocably slidably received in said main body and adjacent to said insertion slit for reciprocating diagonally upwardly and downwardly;

force applying means attached to said single cam block for applying a substantially horizontal force for sliding said single cam block forwardly and rearwardly relative to said main body;

a guide means on said single cam block for causing said single cam block to move diagonally upwardly when said single cam block slides forwardly relative to said main body and for causing said single cam block to move diagonally downwardly when said single cam block slides rearwardly relative to said main body;

a card supporting surface on said single cam block for supporting a card received in said card insertion slit in said main body on said single cam block; and a plain cam surface on said single cam block adjacent to said at least one resilient contacting piece for engaging said contacting piece for keeping said contacting piece and said contact surface means in a normally open position for receiving a card in said insertion slit and on said card supporting surface of said single cam block without contacting said contact surface means, and said plain cam surface causing said contacting piece and said contact surface means to move to the closed position against a card received in said card insertion slit on said card supporting surface when said single cam block moves forwardly and diagonally upwardly relative to said main body by said guide means from an initial position to an intermediate position, and said plain cam surface on said single cam block allowing said contacting piece and said contact surface means to remain in the closed position against a card received in said card insertion slit for rubbing a card against said contact surface means of said at least one contacting piece when said single cam block moves further diagonally upwardly by said guide means from the intermediate position to a final position when a substantially horizontal forward force is applied to said single cam block through said force applying means.

2. A card connector as claimed in claim 1, wherein said guide means on said single cam block includes a diagonal guide cam groove in said single cam block, and a slider is attached to said main body and slidably received in said diagonal guide cam groove.

3. A card connector as claimed in claim 1, wherein said force applying means includes a lever pivotably attached to said main body.

* * * * *